US009938945B2

(12) United States Patent
Dorn et al.

(10) Patent No.: US 9,938,945 B2
(45) Date of Patent: Apr. 10, 2018

(54) TAPPET

(71) Applicant: Schaeffler Technologies GmbH & Co. KG, Herzogenaurach (DE)

(72) Inventors: Stefan Dorn, Hollfeld (DE); Norbert Geyer, Hochstadt (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 523 days.

(21) Appl. No.: 14/413,130

(22) PCT Filed: May 24, 2013

(86) PCT No.: PCT/EP2013/060714

§ 371 (c)(1),
(2) Date: Jan. 6, 2015

(87) PCT Pub. No.: WO2014/005764

PCT Pub. Date: Jan. 9, 2014

(65) Prior Publication Data

US 2015/0159610 A1 Jun. 11, 2015

(30) Foreign Application Priority Data

Jul. 6, 2012 (DE) ..... 10 2012 211 852

(51) Int. Cl.
*F02M 59/10* (2006.01)
*F01L 1/14* (2006.01)

(52) U.S. Cl.
CPC ..... *F02M 59/102* (2013.01); *F01L 1/14* (2013.01); *F01L 2107/00* (2013.01)

(58) Field of Classification Search
CPC ..... F02M 59/102; F04B 9/042
See application file for complete search history.

(56) References Cited

U.S. PATENT DOCUMENTS

2008/0190237 A1 8/2008 Radinger et al.
2010/0229812 A1* 9/2010 Dorn ..... F01L 1/14 123/90.5

(Continued)

FOREIGN PATENT DOCUMENTS

DE 102009013131 9/2010
DE 102009056306 6/2011

(Continued)

*Primary Examiner* — F. Daniel Lopez
(74) *Attorney, Agent, or Firm* — Volpe and Koenig, P.C.

(57) ABSTRACT

A plunger (1) for a high-pressure fuel pump is proposed, having a housing (2) which is similar to a tube and in the drive-side annular face (3) of which two flats (5) lie diametrically opposite one another which are indented from an outer shell (4) of the housing (2) and in which a pin (7) is mounted which supports a roller, wherein an inner shell (8) of the housing (2) is penetrated axially below the roller by a separate bridge piece (9), the lower face (10) of which acts as a rest for a pump piston in the case of an output-side annular face (11) of the housing (2), wherein the bridge piece (9) is fixed against rotation about an axial line of the housing (2) and is configured as a thick-walled longitudinal beam, with the result that an area (13) in the manner of a cylindrical segment remains between the longitudinal walls (12) of said longitudinal beam and the inner shell (8) of the housing (2), wherein, in order to fix the bridge piece (9) against rotation about the axial line of the housing (2), in the circumferential section of the inner shell (8) of the housing (2), in a first transverse wall (14) of the bridge piece (9), at least one projection (15) protrudes from one of the components (8, 14), which projection (15) is seated in a respectively complementary recess (16) of the respective other one of the components (14, 8).

18 Claims, 3 Drawing Sheets

(56) References Cited

U.S. PATENT DOCUMENTS

| | | | |
|---|---|---|---|
| 2012/0234277 | A1 | 9/2012 | Dorn et al. |
| 2013/0068064 | A1 | 3/2013 | Geyer et al. |

FOREIGN PATENT DOCUMENTS

| | | |
|---|---|---|
| DE | 102010022318 | 12/2011 |
| DE | 102010022319 | 12/2011 |

* cited by examiner

TAPPET

BACKGROUND

The invention concerns a tappet particularly for a pump or a compressor, said tappet comprising a tube-like housing comprising two flats which are indented from an outer shell of the housing near a drive-side annular face of the housing (2) and lie diametrically opposite each other, a pin carrying a roller being mounted in said flats, an inner shell of the housing being penetrated axially below the roller by a separate bridge member, a lower face of said bridge member acting near a driven-side annular face of said housing as a support for a tappet follower member, and said bridge member being fixed against rotation about an axial line of the housing.

A tappet of the pre-cited type, in this case for acting upon a pump piston of a high pressure fuel pump of an internal combustion engine, is disclosed in DE 10 2010 022 318 A1. The disk-like bridge member disclosed herein is relatively thin and therefore can no longer cope with the high loads occurring in modern high pressure fuel pumps. It would, however, not be possible to mount a clearly thicker disk-like bridge member and the mass of the tappet would be impermissibly increased. In addition, the bridge member that almost completely fills the tappet in radial direction permits only a poor through-flow of a medium such as for instance diesel oil if the tappet is used in a high pressure fuel pump of a quality controlled internal combustion engine. Moreover, an anti-rotation feature for the bridge member about the axis of the tappet through a one-sided engagement of a lug through a clearance of the housing is only inadequate.

SUMMARY

It is therefore an object of the invention to provide a tappet that is free of the aforesaid drawbacks, is particularly capable of resisting high loads, and has a light weight while possessing a reliably fixed contact of the tappet follower member.

According to the invention, the above object is achieved by the fact that the bridge member is configured as a thick-walled longitudinal beam such that a cylindrical segment-like surface remains between longitudinal walls of the bridge member and the inner shell of the housing, wherein for fixing the bridge member against rotation about the axial line of the housing, in the circumferential section of the inner shell of the housing, in a first transverse wall of the bridge member, at least one projection protrudes from one of the components, which projection is seated in a respective complementary recess of the respective other one of the components.

In this way, a tappet is obtained that is free of the aforesaid drawbacks. Through its beam design that fills the interior of the tappet only partially, the bridge member comprises only a relatively small mass and at the same time, an excellent load bearing ability. Thus there is nothing that speaks against a use of the tappet in a fuel injection pump subjected to high loading. The cylindrical segment-like clearances remaining laterally on the bridge member permit an adequately large through-flow of a lubricant or of diesel oil (depending on the application of the tappet) in both axial directions or prevent, depending on the application, an unnecessary "pumping-up" of air during the oscillating movement of the tappet.

The proposed thick-walled bridge member can be punched out of a blank or cut/hacked from an extrusion molded profile, or can be made out of cast material.

It is particularly preferred, for instance, to let a projection protrude radially inwards from the inner shell of the housing and have it engage with a complementary recess on a transverse wall of the bridge member. In this way, the bridge member is endowed with an excellently simple limitation of rotary movement about the axis of the tappet.

In a further specification of the invention, it is proposed to provide as a projection, a partial material through-stamping or embossing starting from the outer shell of the housing. Alternatively, it is also possible to use an extension such as a material squeezing or the like starting directly from the inner shell.

For a further optimized anti-rotation feature of the bridge member, it is proposed to provide a lug-like extension that protrudes radially from the second transverse wall of the bridge member through a clearance in form of a window or a longitudinal slot of the housing, which extension at the same time creates an anti-rotation feature for the tappet with respect to its guidance when being installed. It necessary, this lug may also be made separately or not protrude beyond the outer shell of the housing so that only the bridge member is fixed against rotation.

As an alternative, the at least one (first) projection may also start from the first transverse wall of the bride member and be received in a complementary recess, shoulder or window in the inner shell of the housing.

If, as stated in an advantageous specification of the invention, at least one transverse wall of the bridge member, such as, for example, the first transverse wall has a flat configuration, the mounting of the bridge member is rendered easier and, as a result, a through-flow of a medium is possible also in this region.

A simple axial fixing of the bridge member when contacted by a cam follower member (e.g. a pump piston) is set forth in a further dependent claim. According to this, the bridge member is to bear against already existing undersides of the flats that extend after the manner of bowstrings through the tappet.

Moreover, it is proposed to arrange a securing ring in the inner shell of the housing for instance in an annular groove, or inwards protruding lugs on which the bridge member is retained in a simple manner in direction of the driven-side annular face. In this way, a simple anti-loss feature is created for the bridge member, for example during transportation and till its mounting. At the same time its axial movement within the housing is generally limited.

The bridge member may extend within the housing with a slight axial and radial lash which enables a simple compensation of tolerances. It is, however, also intended to retain the bridge member in a stationary manner within the housing.

It is proposed, in addition, to provide near each flat, on an upper annular wall of the housing, an extension that protrudes radially inwards and on which the axial movement of the extensions of the pin is limited. The respective extension can be made, for instance, as a simple material incision of the upper annular wall of the housing. In this way, separate axial fixing devices for the pin can be dispensed with.

The proposed tappet is intended for use for at least an indirect loading of a pump piston of a fuel injection pump of a quality or quantity controlled internal combustion engine. It is equally possible to use the tappet in a valve train of an internal combustion engine or in an axial or radial piston compressor or in a corresponding pump.

BRIEF DESCRIPTION OF THE DRAWINGS

The invention will now be described more closely with reference to the appended drawing.

DETAILED DESCRIPTION OF THE PREFERRED EMBODIMENTS

Figure 1:
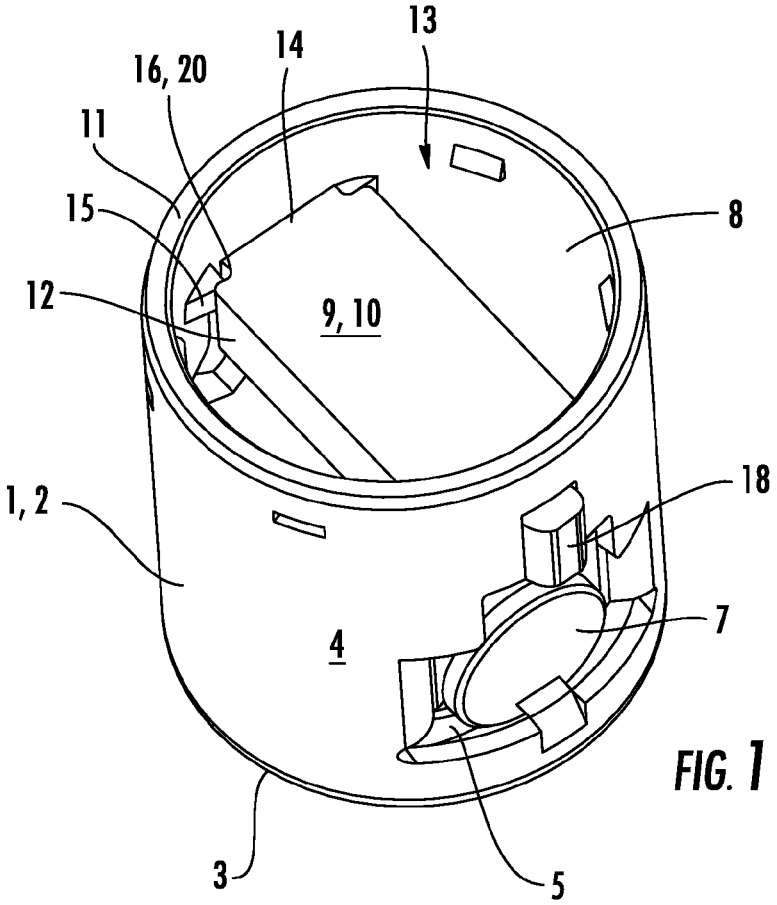
FIG. 1 shows a three dimensional view of the tappet seen from below, showing a first variation of a rotational fixing of the bride member.
Figure 2:
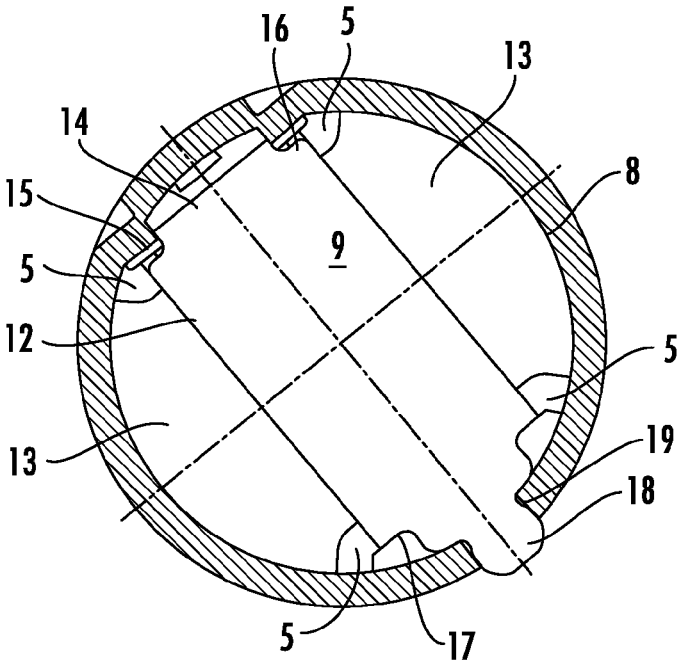
FIG. 2 shows a cross-section through the tappet according to FIG. 1, at the level of the bridge member.

FIGS. 1 and 2 disclose a tappet 1 for a high pressure fuel pump. This possesses a tube-like housing 2 made out of sheet steel. Near a drive-side annular face 3 of the housing 2 are arranged two diametrically opposing flats 5 that are indented from an outer shell 4 of the housing 2. A pin 7 carrying, through a needle roller bearing a roller, not shown, is received in receptions 25 of the flats 5 (see also FIG. 5).

An inner shell 8 of the housing 2 is penetrated axially below the roller by a bridge member 9 that is configured as a longitudinal beam. In this way a cylindrical segment-like space 13 remains between each of the longitudinal walls 12 of the bridge member 9 and the inner shell 8 of the housing 2 for enabling a relatively unobstructed passage of the lubricant.

A lower face 10 of the bridge member 9 situated near a driven-side annular face 11 of the housing 2 functions as a support for a piston pump that constitutes the tappet follower member.

The bridge member 9 is fixed against rotation about an axial line of the housing 2. For this purpose, two integrally formed projections 15 protrude from the inner shell 8 of the housing 4 near a first, almost flat transverse wall 14 of the bridge member 9 and are situated in complementary recesses 16 in the edge region 20 of the transverse wall 14. The projections 15 are configured as material indentations starting from the outer shell 4 of the housing 2.

It can be seen further that, in the region of its second transverse wall 17, the bridge member 9 possesses a lug 18 that extends through a clearance 19 of the housing 2. Through this integrally connected lug 18, the tappet is endowed with a rotational securing relative to its guide. The lug 18 serves at the same time as a further rotational fixing of the bridge member 9 about the axial line of the housing 2.

Figure 3:
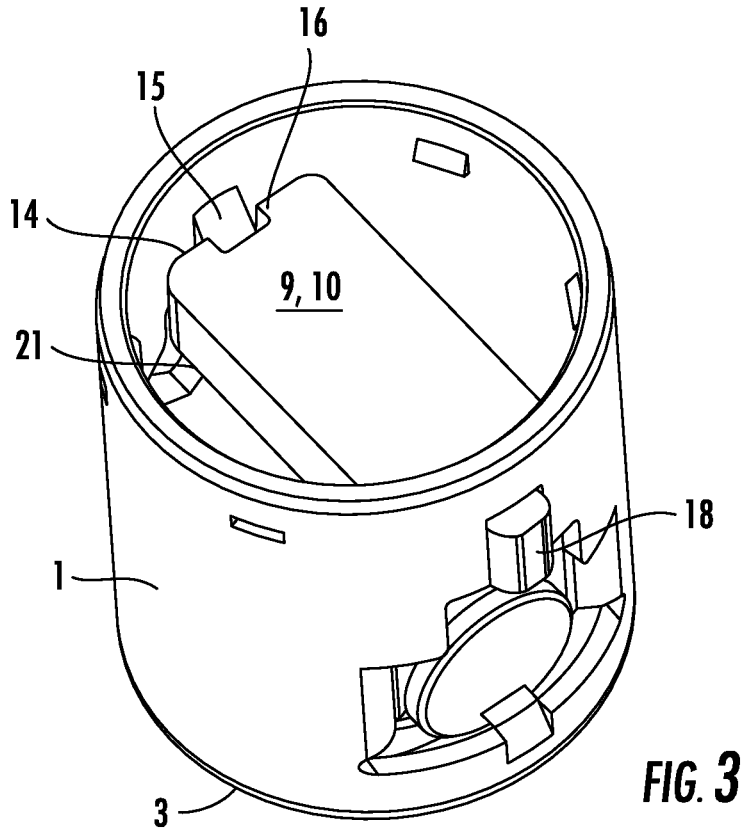
FIG. 3 shows the tappet according to FIG. 1, showing an alternative rotational fixing.
Figure 4:
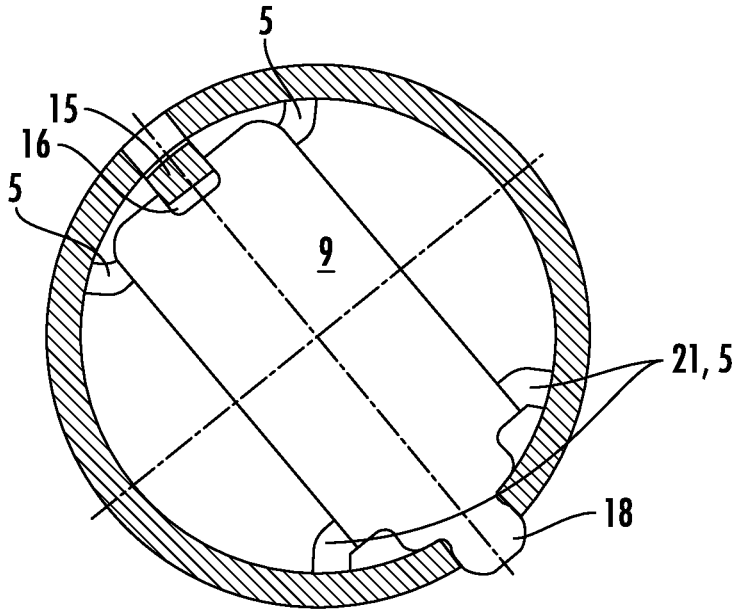
FIG. 4 shows the cross-section corresponding to FIG. 3.
Figure 5:
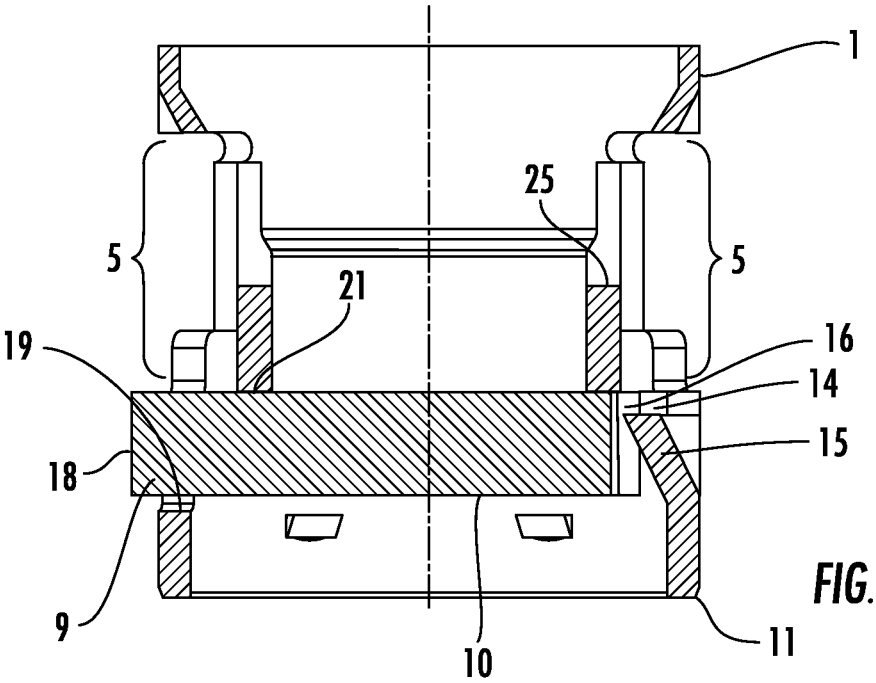
FIG. 5 shows a longitudinal section through the tappet according to FIG. 3 in an upright position, taken in longitudinal direction through the bridge member.

FIGS. 3 to 5 disclose an alternative retention for the bridge member 9 in peripheral direction. In this case, the first transverse wall 14 of the bridge member 9 comprises only one central recess 16 in which a respective projection 15 of the housing 2 is seated.

Figure 6:
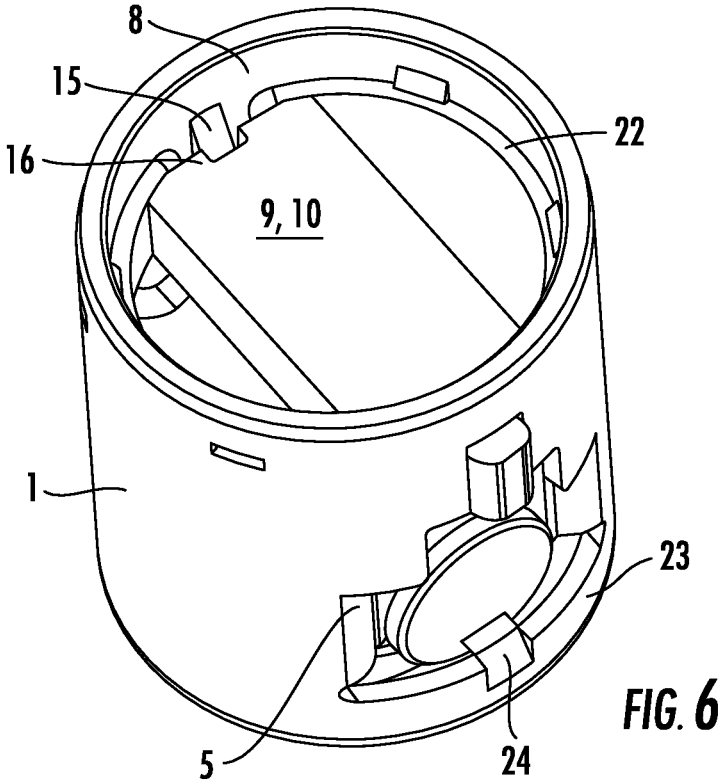
FIG. 6 shows a view similar to FIG. 3, with a securing ring serving as an axial fixing for the bridge member.

The respective recess 15 may comprise a step-like shoulder so that the bridge member 9 is prevented from falling out of the tappet. As disclosed in FIG. 6 in this context, a securing ring 22 is arranged on the inner shell 8 of the housing 2, and the bridge member 9 is retained on this securing ring at its transverse walls 14, 17.

In the direction of the drive-side annular face 3 of the housing 2, the bridge member 9 bears against undersides 21 of the indented flats 5.

Finally, as disclosed in FIGS. 1, 3 and 5, an extension 24 extends integrally, radially inwards from an upper annular wall 23 of the housing 2 near each flat 5 so that the two extensions 24 serve to limit the displacement of the pin 7 in axial direction. The extension 24 is made as a simple material incision.

LIST OF REFERENCE NUMERALS

1 Tappet
2 Housing
3 Drive-side annular face
4 Outer shell
5 Flat
6 Not used
7 Pin
8 Inner shell
9 Bridge member
10 Face
11 Driven-side annular face
12 Longitudinal wall
13 space
14 First transverse wall
15 Projection
16 Recess
17 Second transverse wall
18 Lug
19 Clearance
20 Edge region
21 Underside
22 Securing ring
23 Annular wall
24 Extension
25 Reception

The invention claimed is:

1. A tappet, comprising a tube-shaped housing defining an axis and comprising two flats which extend inward from the housing near a drive-side annular face of the housing and lie diametrically opposite each other, a pin for carrying a roller, the pin being mounted in said flats, a bridge member engaging the housing axially below the pin, a lower face of said bridge member configured to support a tappet follower member near a driven-side annular face of said housing, and said bridge member being fixed against rotation about the axis of the housing, wherein the bridge member is configured as a beam such that a pair of cylindrical segment-shaped spaces remain between longitudinal walls of the bridge member and the inner shell of the housing, wherein to fix the bridge member against rotation about the axial line of the housing, in a circumferential section of the inner shell of the housing, at least one projection protrudes from one of the inner shell or a first transverse wall of the bridge member, said projection is seated in a respective complementary recess of the respective other one of the first transverse wall or the inner shell, wherein undersides of the flats fix the bridge member in a direction of the drive-side annular face of the housing, and wherein at least one extension protrudes radially inwards from an upper annular wall of the housing near each of the flats, and said extensions limit an axial displacement of the pin.

2. The tappet according to claim 1, wherein for a further fixing of the bridge member against rotation about the axial line of the housing, the bridge member comprises in a region of a second transverse wall a lug that extends through a clearance of the housing.

3. The tappet according to claim 2, wherein for rotationally securing the tappet relative to a surrounding structure, the lug protrudes beyond the outer shell of the housing.

4. The tappet according to claim 1, wherein the at least one projection is in the housing, and wherein the first transverse wall of the bridge member comprises either a) said complementary recess located approximately in a central position, or b) two complementary recesses located near edge regions of the bridge member to the longitudinal walls.

5. The tappet according to claim 1, wherein the at least one projection is in the housing, and configured either a) as an embossing/material stamping starting from the outer shell of the housing, b) as rudimentary stampings on the inner shell of the housing, or c) as weld or solder spots on the inner shell of the housing.

6. The tappet according to claim 1, wherein the first transverse wall of the bridge member is approximately flat except for said projection or said recess.

7. The tappet according to claim 1, wherein the bridge member is fixed in a direction of the driven-side annular face of the housing through support on a securing ring that is fixed on the inner shell of the housing.

8. The tappet according to claim 1, wherein the bridge member is retained within the housing with a slight axial and radial lash.

9. A tappet for a pump or a compressor, comprising a tube-like housing longitudinally defining an axis, including:

two diametrically opposed flats indented from the housing near a drive-side annular face of the housing, an inner surface, and at least one radial projection located above the flats;

a bridge member mounted on a respective underside of each flat and having a generally rectangular cross-section, the bridge member including:

a lower face configured to support a tappet follower member, a first transverse wall at a first end of the bridge member, the first transverse wall engaging the inner surface of the housing, a lug extending from a second transverse wall at a second end of the bridge member, the lug penetrating the inner surface of the housing;

at least one projection protruding from the housing or the bridge member;

at least one complementary recess formed in the housing or the bridge member for receiving the at least one projection and fixing the bridge member against rotation about the axis; and a pin mounted in receptions of each flat, the receptions being located on an opposite face of the flats from the undersides.

10. The tappet according to claim 9, wherein the bridge member, when assembled in the housing, has a consistent cross-section along an inner diameter of the housing.

11. The tapped according to claim 9, the bridge member including a lower face that is substantially flat, the lower face being situated near a driven side of the housing.

12. A tappet, comprising a tube-shaped housing defining an axis and comprising two flats which are indented from an outer shell of the housing near a drive-side annular face of the housing and lie diametrically opposite each other, a pin for carrying a roller, the pin being mounted in said flats, a bridge member engaging an inner shell of the housing axially below the pin, a lower face of said bridge member configured to support a tappet follower member near a driven-side annular face of said housing, and said bridge member being fixed against rotation about the axis of the housing, wherein the bridge member is configured as a beam such that a pair of cylindrical segment-shaped spaces remain between longitudinal walls of the bridge member and the inner shell of the housing, wherein to fix the bridge member against rotation about the axial line of the housing, in a circumferential section of the inner shell of the housing, at least one projection protrudes from one of the inner shell or the first transverse wall, said projection is seated in a respective complementary recess of the respective other one of the first transverse wall or the inner shell, and wherein at least one extension protrudes radially inwards from an upper annular wall of the housing near each of the flats, and said extensions limit an axial displacement of the pin.

13. The tappet according to claim 12, wherein for a further fixing of the bridge member against rotation about the axial line of the housing, the bridge member comprises in a region of a second transverse wall a lug that extends through a clearance of the housing.

14. The tappet according to claim 13, wherein for rotationally securing the tappet relative to a surrounding structure, the lug protrudes beyond the outer shell of the housing.

15. The tappet according to claim 12, wherein the at least one projection is in the housing, and wherein the first transverse wall of the bridge member comprises either a) said complementary recess located approximately in a central position, or b) two complementary recesses located near edge regions of the bridge member to the longitudinal walls.

16. The tappet according to claim 12, wherein the at least one projection is in the housing, and configured either a) as an embossing/material stamping starting from the outer shell of the housing, b) as rudimentary stampings on the inner shell of the housing, or c) as weld or solder spots on the inner shell of the housing.

17. The tappet according to claim 12, wherein the bridge member is fixed in a direction of the driven-side annular face of the housing through support on a securing ring that is fixed on the inner shell of the housing.

18. The tappet according to claim 12, wherein the bridge member is retained within the housing with a slight axial and radial lash.

* * * * *